US007811216B2

(12) United States Patent
Babiarz

(10) Patent No.: US 7,811,216 B2
(45) Date of Patent: Oct. 12, 2010

(54) INFLATABLE EXERCISE APPARATUS

(75) Inventor: Shawn P. Babiarz, Chicago, IL (US)

(73) Assignee: KoreExtreme, LLC, Chicago, IL (US)

( * ) Notice: Subject to any disclaimer, the term of this patent is extended or adjusted under 35 U.S.C. 154(b) by 0 days.

(21) Appl. No.: 12/572,402

(22) Filed: Oct. 2, 2009

(65) Prior Publication Data

US 2010/0087299 A1 Apr. 8, 2010

Related U.S. Application Data

(60) Provisional application No. 61/102,050, filed on Oct. 2, 2008.

(51) Int. Cl.
*A63B 26/00* (2006.01)

(52) U.S. Cl. ..... 482/142; 446/220

(58) Field of Classification Search ..... 482/140, 482/142, 148, 139, 23, 55, 51–53, 56; 446/220
See application file for complete search history.

(56) References Cited

U.S. PATENT DOCUMENTS 6,422,983 B1 * 7/2002 Weck ..... 482/147
6,554,753 B1 4/2003 Weck et al.
6,575,855 B1 6/2003 Buzak et al.
6,702,726 B2 * 3/2004 Lin ..... 482/148
7,074,166 B2 * 7/2006 Weitzman ..... 482/142
7,156,787 B2 * 1/2007 Kemery et al. ..... 482/140
7,207,930 B2 * 4/2007 Bonutti ..... 482/111
7,448,984 B2 * 11/2008 Chow ..... 482/8
2003/0139255 A1 * 7/2003 Lina ..... 482/24
2007/0061976 A1 * 3/2007 Bazargani ..... 5/644

OTHER PUBLICATIONS

U.S. Appl. No. 29/344,700, entitled Inflatable Exercise Apparatus, filed Oct. 2, 2009; named inventor: Shawn P. Babiarz.
U.S. Appl. No. 29/344,703, entitled Inflatable Exercise Apparatus, filed Oct. 2, 2009; named inventor: Shawn P. Babiarz.

* cited by examiner

*Primary Examiner*—Lori Baker
(74) *Attorney, Agent, or Firm*—McAndrews, Held & Malloy, Ltd.

(57) ABSTRACT

An inflatable exercise apparatus having inflatable bladder segments in fluid communication with each other. The inflatable exercise apparatus includes a valve control mechanism that may control the flow of a fluid between the bladder segments, thereby allowing for the adjustment of the pressure in each bladder segment. Adjusting the pressure in each bladder segment may allow the user to vary the levels of resistance during exercise. The bladder segments may be operably connected to bases. The bladder segments may have a plateau that is configured to accommodate each user's stance dimension, along with ridges to assist in securing the feet of the user in a neutral position. The apparatus may also include band brackets for the attachment of other exercise devices, for example exercise bands or balancing devices. The bases may be pivotably connected so as to allow the apparatus to fold to accommodate a storage state.

22 Claims, 9 Drawing Sheets

INFLATABLE EXERCISE APPARATUS

RELATED APPLICATIONS

This application claims the benefit of U.S. Provisional Application No. 61/102,050, filed Oct. 2, 2008, which is incorporated herein by reference in its entirety.

BACKGROUND OF THE INVENTION

Embodiments of the present invention generally relate to exercise and physical rehabilitation equipment. More particularly, embodiments of the present invention relate to an inflatable exercise apparatus that may include at least two inflatable bladder segments in controllable fluid communication with each other. The bladder segments may be at least partially inflated through the use of a fluid, including a liquid and/or a gas, such as, for example, air, among others. The fluid communication between each bladder segment may allow the degree of inflation of each bladder segment to be adjusted and controlled without having to add or release fluid to/from the apparatus. More specifically, the fluid communication between the bladder segments allow fluid to be transferred from a first bladder segment to a second bladder segment, and vice versa, so that each bladder segment may be adjusted to provide similar or different degrees of resistance during exercises.

Individuals may engage in physical exercise for the same or different purposes, such as improving physical conditioning, strength training, rehabilitating from an injury or trauma, and/or seeking to address a physical disability, among others. Accordingly, exercise regimens or activities may be undertaken to address any of these purposes. For example, physical rehabilitation regiments may involve, among others, exercise activities directed to strengthening the muscles, increasing balance capabilities, increasing patient perceptual self awareness, and/or improving the flexibility of an individual's outer extremities, such as the arms and legs. Such physical rehabilitation regiments may be directed towards individuals or patients who are physically challenged, such as those that have suffered a stroke or traumatic head injury, and/or those individuals who are physically disabled. Further, older, physically active individuals may be prone to sports or activity related injuries. Additionally, physically challenged individuals may require constant physical rehabilitation throughout their lives, and may be more prone to injury due to their challenged abilities. Such individuals may also develop an increased risk for hospitalization due to their physical limitations, and require subsequent follow-up physical therapy after they have been discharged from hospital. Intense physical therapy programs are now a regular part of the lives of many individuals who are physically disabled. Such physically disabled individuals, such as those having Cerebral Palsy and Multiple Sclerosis, may constantly fight to maintain and possibly gain physical function throughout their lives.

Additionally, physical fitness businesses such as gyms and personal trainers have become increasingly important in recent decades because of generally, an increased sedentary life style that many people in today's society have embraced. Many exercise routines such as yoga, Pilates and weight lifting are employed to increase physical fitness and improve muscles and flexibility. Further, many older individuals today are embracing cross training and sports, such as wind surfing, triathlons, marathons and/or volleyball, that may not have been as popular with their generation several years ago.

The need to participate in some sort of strengthening or physical activity has given rise to many types of exercise devices, such as, for example, nautilus weights, stationary bikes, treadmills and elliptical trainers. Yet, due to the cost and size of such devices, many individuals do not have the resources to purchase such devices. Further, particularly with respect to physical rehabilitation patients, there are individuals who do not have the physical capacity to use such devices. And the cost and lack of portability typically prevents Physical Therapists from using this equipment in a home health setting.

Several types of simple devices have appeared that can contribute to the overall fitness of the individual. One such device is an exercise ball. However, because the balls tend to roll and pitch, exercise becomes very challenging. Further, such a device may be too challenging for individuals just starting an exercise program, or who are beginning their rehabilitation after an injury. Also, the size of the ball makes it cumbersome to have in the home. Another exercise is the Step aerobic exercise. In Step exercise, an elevated platform (the step) is used. The height can be tailored to individual taste by inserting risers under the step. Step aerobics classes are offered at many gyms and fitness centers. But a problem with Step exercise is that it puts a great deal of stress on the knees. Specifically, the full impact of the user is transferred to the lower leg and back structures of the user. It is also impossible to simulate various walking surfaces (such as soft ground, grass and/or carpeting) with this device. This may prohibit a stroke or traumatic brain injury patient from gaining walking independence in an outdoor environment.

Further, static, inflatable exercise devices being used today typically incorporate a stepping area that has a generally circular shaped configuration. However, by using a circular configuration, the bladder ascends to a relatively small apex. This small apex may limit the size of the footprint created by an individual stepping on such devices, which may adversely affect the stability of and/or comfort of using the device. A small apex may also prevent the user from keeping their ankle in a neutral position while using the device, which may increase the potential that the individual may sprain or otherwise injure his/her ankle during exercise. Such stability and/or comfort issues may be of particular importance to a physical rehabilitation patient, as such patients may already have diminished strength and/or balance and may be at increased risk for injury, may be in the process of rehabilitation.

BRIEF SUMMARY OF THE INVENTION

Embodiments of the present invention relate to an inflatable exercise apparatus having at least two bladder segments that are in controllable fluid communication with each other, such as, for example, through a fluid passageway. The bladder segments may have an upper surface, side surfaces, and a bottom surface. According to certain embodiments, at least a portion of the bladder segments may include generally elliptical shaped upper surfaces that are adapted to receive the assertion of the outer extremity of a user against the bladder segment(s), such as, for example, the user standing on one or more of the bladder segments or the user placing his/her hands and/or arms against the apparatus, such as, for example, when performing a push-up on the apparatus. The inflatable bladder may be constructed from a variety of different relatively resilient flexible material, including, for example, vinyl, elastomeric, composite, or PVC materials that allow at least a portion of the bladder to be deform when the users is exerts a force against the bladder, and then generally regain its shape when the exerted force is removed.

According to certain embodiments, the inflatable exercise apparatus includes a valve control mechanism that may be used in controlling the flow of fluid, such as air, between the bladder segments. More specifically, the valve control mechanism may be used in regulating the gas pressure in bladder segments. For example, when the valve control mechanism is at least partially opened, pressure exerted on a first bladder segment may force a fluid, such as air, through the fluid passageway and into a second bladder segment. The valve control mechanism may then be closed so that at least a portion of the air that has been communicated to the second bladder segment by pressing on the first bladder segment remains either in the second bladder segment or the portion of the fluid pathway that is adjacent to the second bladder segment. Alternatively, the valve mechanism may remain open during use, whereby the valve control mechanism, such as, for example, a ball valve mechanism such as a clamp ball valve, among other valves, is used to adjust the resistance provided by the bladder segment during use, and thereby allows the user to adjust the difficulty of the exercise session. According to certain embodiment, the valve control mechanism may be located on, in, or around the connecting fluid passageway between the bladder segments. The flow of fluid allows the apparatus of the present invention to be used in a dynamic or static fashion.

According to certain embodiments, at least one of the bladder segments may be operably connected to at least one fluid intake valve that allows fluid, such as ambient air, for example, to be transferred into the bladder segment, such as through the use of a pump, so as to inflate the bladder segment (s). According to some embodiments, each bladder segment may have its own fluid intake valve for filling the individual bladders. With such embodiments, by closing the valve control mechanism so as to prevent fluid communication between the bladder segments, each bladder segment may be inflated or deflated independently through the gas intake valve so as to accommodate different gas pressure in each bladder segment. According to other embodiments, the fluid valve mechanism may be operably connected to the valve control mechanism or a connecting fluid passageway. According to embodiments of the present invention, the apparatus may also include a measuring gauge which may provide an indication of the resistance in, or flowing between, one or more of the bladder segments. Such a gauge may indicate to the user the degree of resistance the bladder segment(s) may provide when the user exerts a force against the bladder segment(s). The gage may be connected to the bladder segment(s), fluid passageway, and/or valve mechanism, and detect pressure and/or flow.

Adjustment of the amount of fluid in the bladder segments may also allow the apparatus of the present invention to be adjusted to accommodate the height of the individual user. More specifically, the height of the apparatus may be adjusted by adding or removing fluid from the bladder segments, which may allow for adjustment of the vertical height of the apparatus, and thereby permit adjustment in the height of the apparatus for the user.

According to certain embodiments, each bladder segment may be operably attached to a base that has a top portion and a bottom portion. The bottom and/or side surfaces of the bladder segment may be mated and attached to the base through the use of an adhesive or mechanical fasteners, including snaps, ties, screws, bolts, and hook and loop material, among others. According to certain embodiments, the bladder and base may be operably connected through a male-female connection. For example, the base and bladder segments may have mating surfaces or sections that allow for the bladder segment and base to be securely attached to each other. More specifically, the bladder segment(s) may include openings or protrusions that mate with/in a protrusion or opening in base.

Further, the base may be solid, or have a ring configuration that surrounds at least a portion of the bladder segment, or may include a pocket or recess upon which at least a portion of the bladder segment is placed, and which is configured to accommodate the deformation of the shape of the bladder segment during use. According to some embodiments, the base may be constructed from a flexible or rigid material.

According to some embodiments, at least a portion of the bottom of the base may be configured to increase friction between the base and the adjacent floor surface so as to assist in preventing the apparatus from sliding on the floor during use. According to other embodiments, a material, such as rubber pads or a flexible non-slidable ring of material, among others, may be attached to the base, such as by a mechanical fastener or adhesive, to prevent the base from sliding due to friction between the flexible material and the floor. According to certain embodiments, the bottom surface of the base may prevent the bladder segment from touching the floor.

Additionally, according to certain embodiments, at least a portion of the inflatable exercise apparatus may be pivoted or folded to accommodate a storage state. According to certain embodiments, a hinge is positioned between the bladder segments that allow the apparatus to be folded or closed, similar to a clamshell. For example, according to an embodiment, the valve control mechanism may include pivotable hinges that allow the bladder segments to be pivoted around the valve control mechanism such that the bottoms of the bases beneath the bladder segments or the tops of the bladder segments are brought toward each other to provide for a compact storage state. Additionally, according to certain embodiments, the bladders and/or base may have appendages formed, attached, or otherwise connected to the bladders and/or base that enable the apparatus to stand in a generally upright position.

The upper surface of the bladder segments may be configured to include an apex with a plateau that is configured to accommodate each user's varying stance dimension. For example, according to embodiments of the present invention, the bladder segment may have a generally oblong elliptical shape. Thus, the bladder segments of the system can accommodate various stance dimensions of various users. Because of this flexibility each user can comfortably stand on the bladder segments without over stressing the lower leg structures, and thus keep the feet and ankles in a neutral position. Also, the apex is designed with ridges that will collapse and secure the feet of various users to further secure their feet in neutral positions. These ridges help decrease probable foot and ankle injuries while the device is in use.

According to certain embodiments, the apparatus of the present invention may also include one or more brackets for the attachment of additional exercise equipment to the device, such as, for example, therabands and/or powercords. The inclusion of these additional exercise apparatuses may allow the user to perform multiple additional motions throughout an action, and enable the user to increase or decrease their level of difficulty in a quick and convenient manner as they see fit. The brackets may be attached to the base and/or bladder segment(s).

Figure 1:
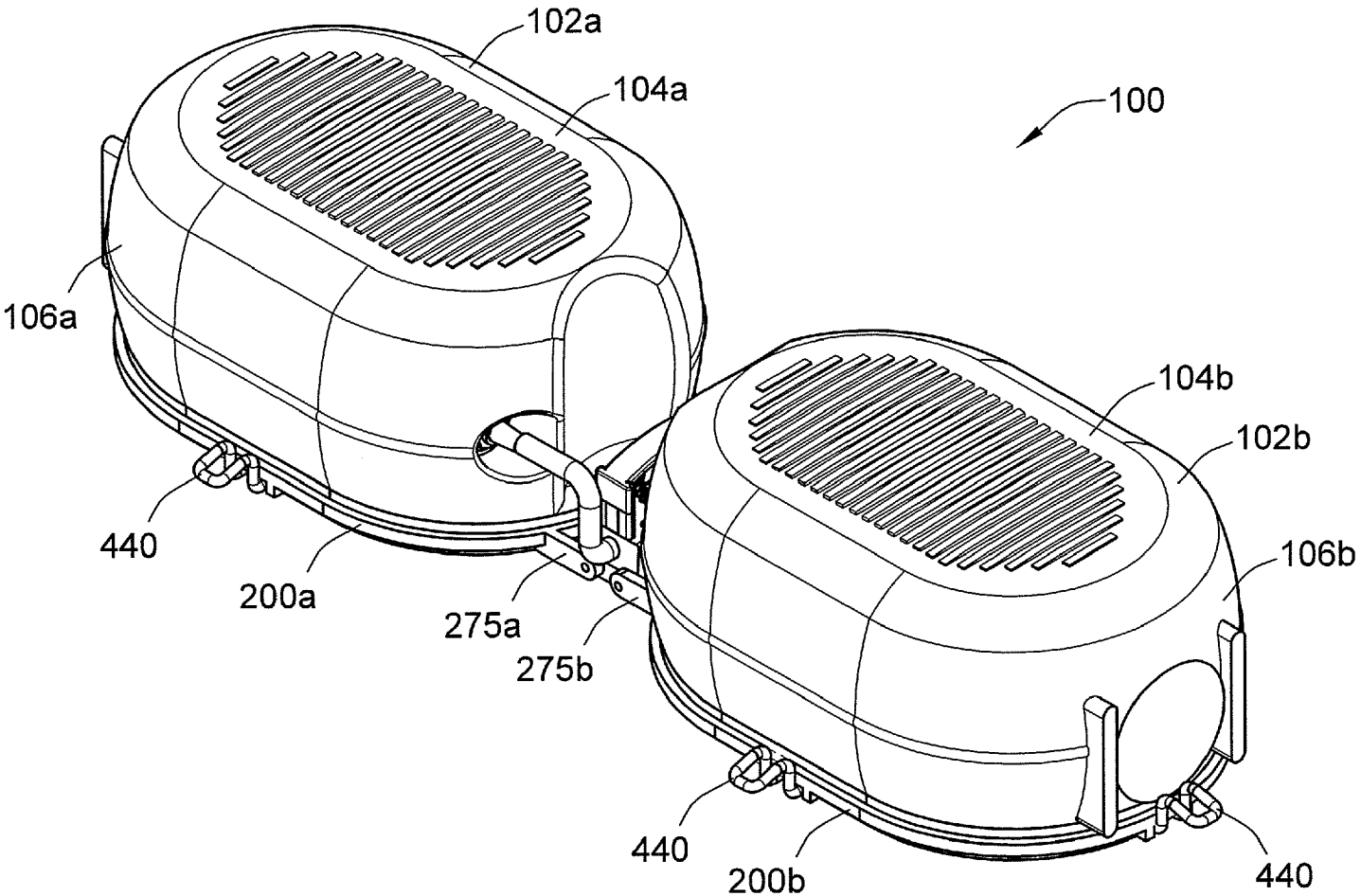
FIG. 1 illustrates a perspective view of an inflatable exercise apparatus according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates perspective and top views, respectively, of an inflatable exercise apparatus 100 according to an embodiment of the present invention. The inflatable exercise apparatus 100 includes at least two inflatable bladder segments, such as a first bladder segment 102 and a second bladder segment 104. Each of the first and second bladder segments 102*a*, 102*b* may include an upper surface 104*a*, 104*b*, a lower surface, and side surfaces 106*a*, 106*b*. It is contemplated that the bladder segments 102*a*, 102*b* may be constructed from a variety of different relatively resilient flexible material, including, for example, vinyl, elastomeric, composite, or PVC materials that allow at least a portion of the bladder to be deform when the users is exerts a force against the bladder, and then generally regain its shape when the exerted force is removed.

Figure 2:
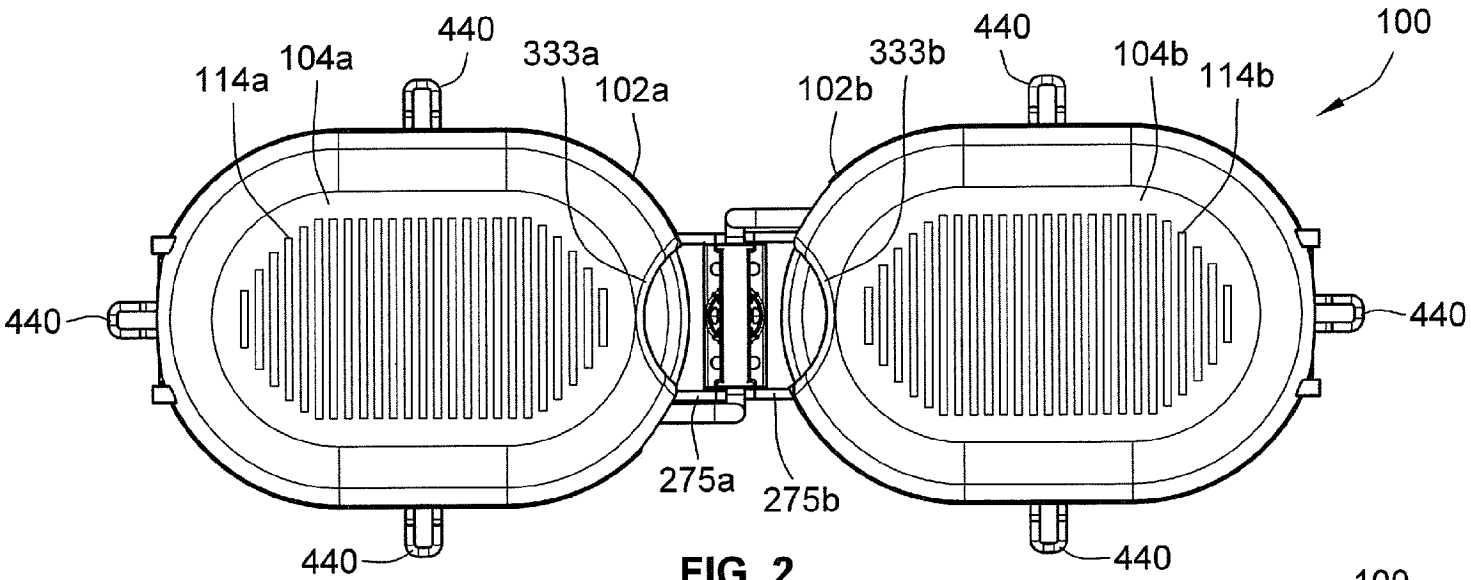
FIG. 2 illustrates a top view of an inflatable exercise apparatus according to an embodiment of the present invention.

As shown in FIGS. 1 and 2, the bladder segments 102*a*, 102*b* are shown to have a generally elongated shape. According to an embodiment illustrated in FIGS. 1 and 2, when placed in a position for use, at least a portion of the sides surfaces 106*a*, 106*b* of the bladder segments may be generally perpendicular to the ground, before transitioning to the upper surface 104*a*, 104*b*. The size, shape, and length of transition between the side surfaces 106*a*, 106*b* and the upper surface 104*a*, 104*b* may vary, including, for example, being an angled chamfer or rounded, among others. According to certain embodiments, the side surfaces 106*a*, 106*b* may not include any transition between the generally perpendicular side surfaces 106*a*, 106*b*, and the top surface 104*a*, 104*b*. Additionally, the orientation of the sides may change as the pressure of the fluid in the bladder segments 102*a*, 102*b* changes. For example, according to an embodiment, the side surfaces 106*a*, 106*b* may appear to have a slight curvature. However, it is contemplated that any shape may be employed for the bladder segments 102*a*, 102*b* that can support the weight of a user and deform to accommodate the user's feet or other bodily parts, such as knees. For example, according to embodiments of the present invention, the bladder segments 102*a*, 102*b* may have a generally oblong elliptical shape that provides a relatively flat or elongated plateau at the apex of the bladder segment 102*a*, 102*b*. However, the bladder may take on various different shapes and sizes besides that shown in FIGS. 1 and 2, including, for example, having rounded, straight, angled, or curved sidewalls, among others.

Figure 3:
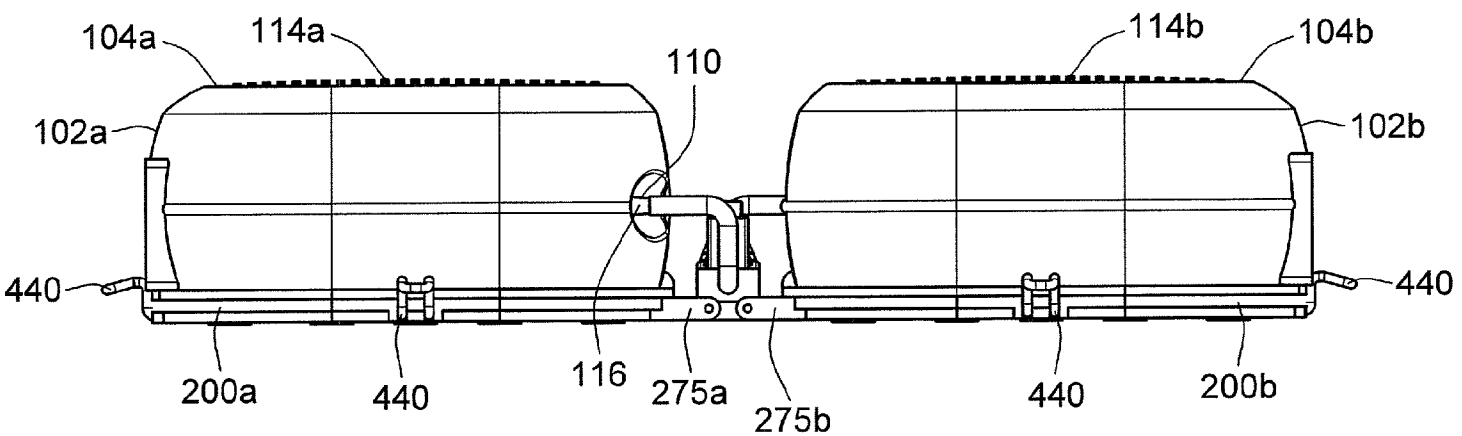
FIG. 3 illustrates a side perspective view of an inflatable exercise apparatus according to an embodiment of the present invention.

FIG. 3 illustrates a side perspective view of an inflatable exercise apparatus 100 according to an embodiment of the present invention. As shown in FIG. 3, the upper surface 104 of the bladder segment 102 may be configured to include a plateau 112 upon which the user may place his/her foot or other outer extremity. For example, according to an embodiment of the present invention, the first and second bladder segments 102 may have a generally oblong elliptical shape. The length and width of the plateau 112 may be configured to accommodate the use of the apparatus 100 by a number of users that have various stance dimensions. Because of this flexibility, each user can comfortably stand on the bladder segments 102 with the feet and ankles of the user in a neutral position.

As also shown in FIG. 3, according to certain embodiments, the upper surface 106 may also include ridges 114, groves, protrusions, or other surface modifications or irregularities positioned above at least a portion of the plateau 112. The ridges 114 may be constructed from the same or different material as that used to construct the bladder 102. Additionally, the ridges 114 may be configured so that the ridges 114 bend, collapse, and/or are compressed when pressure is applied to the ridges 114 by the user, such as, for example, the user placing pressure on the ridges 114 by standing on the ridges 114. The ridges 114 may at least assist in securing or enhancing the stability, griping, or traction of the foot or shoe of the user or other extremity of the user in a neutral position on the bladder so as to assist in decreasing the changes of foot and ankle injuries while the device is in use. For example, when an extremity of the user is placed or pressed against the bladder segment 102, such as, for example, the foot or shoe of the user standing on the bladder segment 102, at least a portion of the ridges 114 beneath that extremity may collapse, while at least a portion of the ridges 114 surrounding the perimeter of that extremity may conform to the shape of the extremity, and thereby assist in preventing the extremity from slipping off of the bladder segment 102. As shown in FIG. 3, the overall profile created by the ridges 114 may have a slight curvature which may indicate to the user the center of the bladder segment 102. However, according to another embodiment, the profile of the ridges 114 may be generally flat.

As also shown in FIG. 3, according to certain embodiments, at least one of the bladder segments 102 may also include a fluid intake valve 110. According to certain embodiments, one or more of the bladder segments 102*a*, 102*b* may have its own fluid intake valve 110. The fluid intake valve 110 may be accessed through a variety of different locations, such as, for example, through the bottom of the base 200, or along the connecting fluid passageway. The fluid intake valve 110 may be molded as part of, or into, the bladder segment 102. Alternatively, the fluid intake valve 110 may be operably connected or attached to the bladder segment 102, such as, for example, by adhering or mechanically fastening the fluid intake valve 110 to the bladder segment 102.

The fluid intake valve 110 may be configured to allow fluid to be released from, or received by, the bladder segment 102. It is contemplated that the inflation fluid used to inflate the bladder segments 102*a*, 102*b* may be air, however any gas or liquid may be used that is safe for the user, the material and the environment. For example, according to an embodiment of the present invention, the fluid intake valve 110 may include a stem 116 that is configured to mate with a pump that pumps fluid into the bladder segment 102 so as to inflate the bladder segment 102. However, it should be understood that any fluid intake valve 110 may be used that can safely inflate/deflate the bladder segments 102*a*, 102*b*, including a stem valve similar to that used with bicycle inner tubes or stem valves having a closeable cap.

Figure 4:
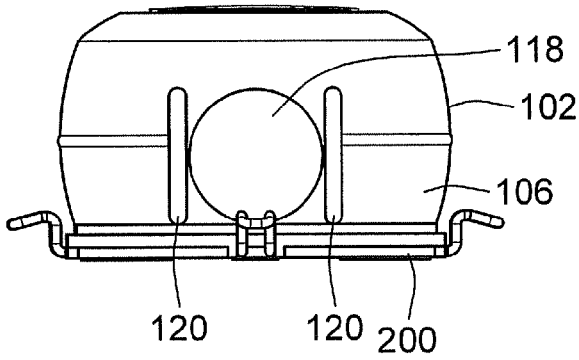
FIG. 4 illustrates a side view of an inflatable exercise apparatus according to an embodiment of the present invention.

FIG. 4 illustrates a side view of an inflatable exercise apparatus 100 according to an embodiment of the present invention. As shown in FIG. 4, according to an embodiment of the present invention, at least a portion of the side surfaces 106 may include be configured to allow each the bladder segment to stand upright when in a folded, or storage, position, as shown by the bladder segment 164*a* illustrated in FIG. 14. For example, the side surface 106 may include a flat portion 118 that is configured to abut against a floor or other surface when the apparatus 100 is standing upright and in a folded position. According to an embodiment of the present invention shown in FIG. 4, the flat portion 118 may have a general contour different than that of the surrounding side surfaces 106, or is an abrupt change from the contour of the surrounding surfaces 106. According to another embodiment, the side surfaces 106 of the bladder segment 102 may include, or be operably connected to, legs 120 that are configured to allow the apparatus 100 to stand upright when the apparatus 100 is in a folded position. The legs may be molded with or onto the bladder segment 102, or may be connected to the bladder 102 through the use of an adhesive or mechanical fasteners, among others.

Figure 5:
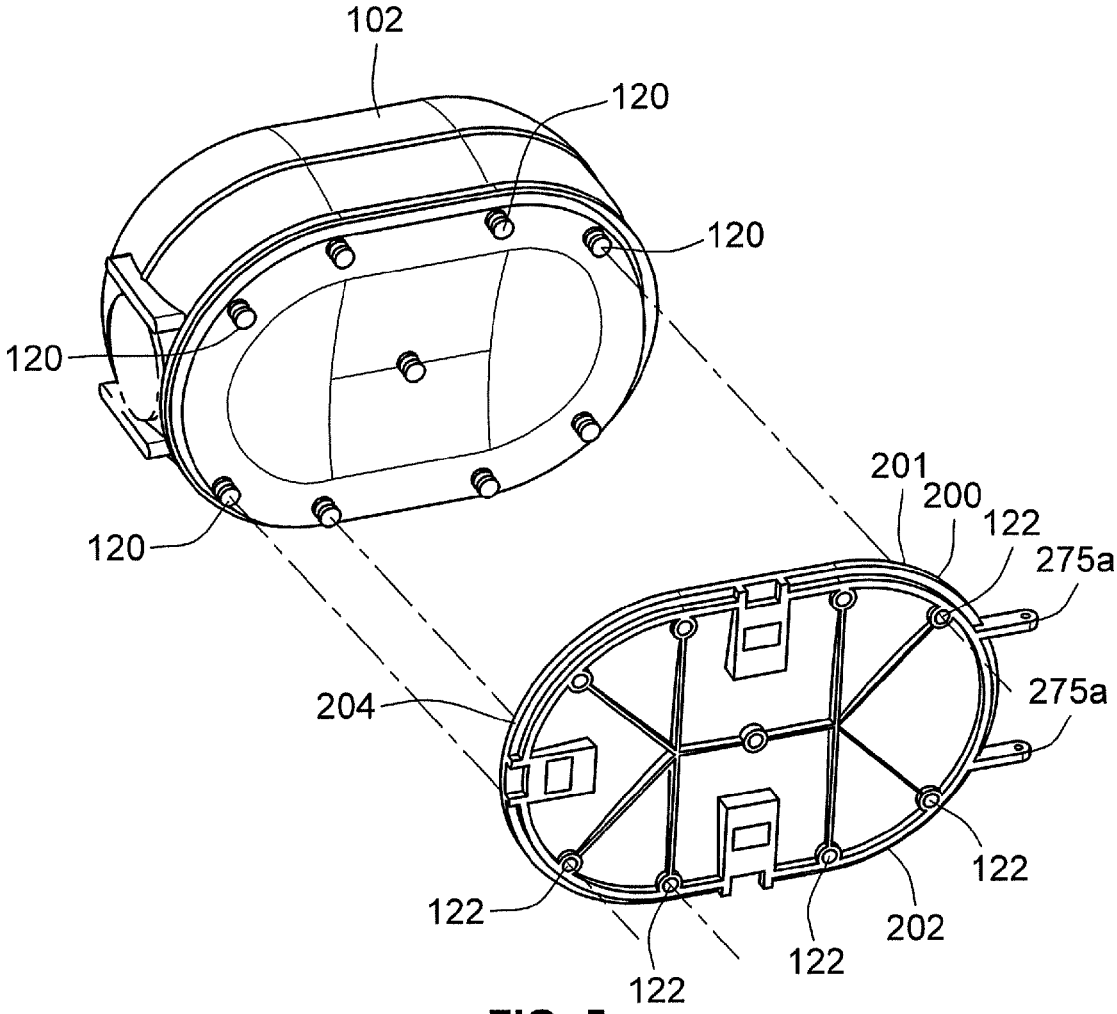
FIG. 5 illustrates an exploded view of a bladder segment and a base according to an embodiment of the present invention.

FIG. 5 illustrates an exploded view of a bladder segment 102 and a base 200 according to an embodiment of the present invention. Each bladder 102*a*, 102*b* may be connected to its own base, as shown by the bases 200*a*, 200*b* below bladder segments 102*a*, 102*b* in FIGS. 1 and 3, or, alternatively to the same base. The base 200 may be configured and size to generally conform to the outside dimensions of the bladder segment 200. Additionally, the base 200 may be made out of any suitable material that will support the weight of the user when the user is positioned on the bladder segments 102*a*, 102*b*, such as plastic, metal or wood.

As shown in FIG. 5, the base 200 may include a base plate 201 and side walls 204. According to an embodiment of the present invention, the base plate 201 and the side walls 204 may be part of the same piece of material. The base plate 201 may provide a protective covering over at least a portion of the bottom portion of the bladder segment 102. The base plate 201 includes a bottom surface 202 that may be configured to increase the friction between the base 200 and the adjacent floor surface so as to attempt to reduce slippage of the inflatable exercise apparatus 100 during use, such as for example, a knurled surface. Alternatively, anti-slippage rings, pads, or feet may be attached to the bottom surface 202 of the base 200, such as a ring of friction material, which may increase friction between the base 200 and the floor to prevent the base 200 from sliding on the floor when the inflatable exercise apparatus 100 is in use.

The bladder segment 102 is operably connected or attached to the base 200. For example, according to embodiments, the bladder segment 102 may be adhered to the base 200, such as, for example, through the use of an adhesive. In an alternative embodiment, the bladder 102 and/or base 200 may be formed with tabs, slots, or openings that allow for the at least partial insertion of a mechanical fastener, such as a bolt, screw, or pin, to secure the bladder segment 102 to the base 200. According to other embodiments, the bladder segment 102 may be formed to include tabs that fit, slide, or snap, into slots located in the base 200.

Figure 6:
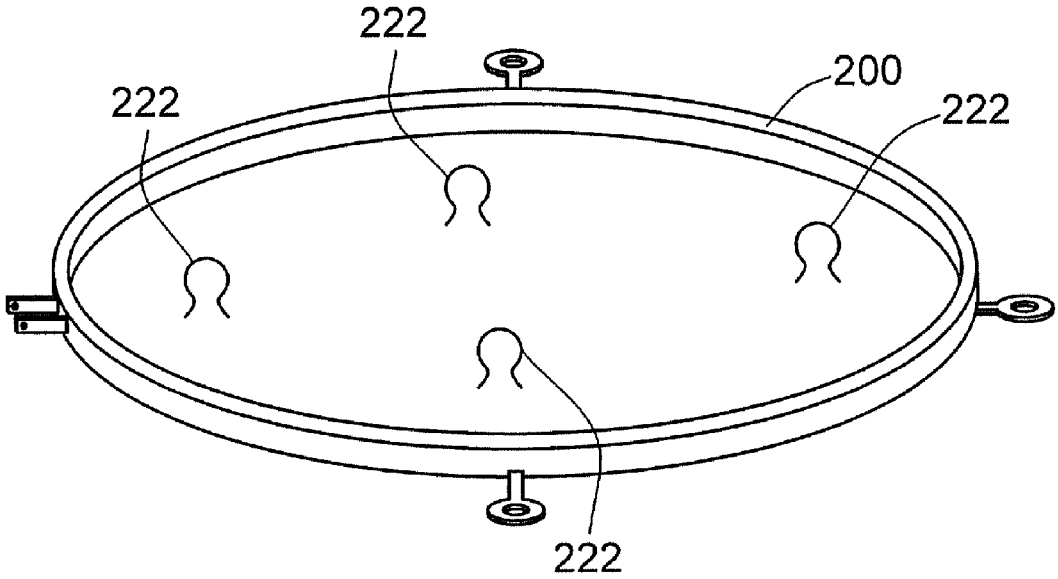
FIG. 6 illustrates a base having protrusions according to an embodiment of the present invention.

According to another embodiment, the bladder segment 102 may include one or more protrusions and/or orifices that mate with orifices and/or protrusions of the base 200, such as, for example to create a male-female connection. For example, in FIG. 5, the bladder segment 102 has a plurality of protrusions 120 extending from the bottom of the bladder segment 102 that are received by orifices 122 in the base 200. Alternatively, FIG. 6 illustrates a base 200 having protrusions 222 according to an embodiment of the present invention. According to the embodiment illustrated in FIG. 6, the bladder segment 102 may have orifices, slots, or grooves, which mate the protrusions 222 of the base 200. A variety of different shapes and sizes of protrusions 122 extending from the bladder segment 102 or protrusions extending from the base 200, and the mating orifices may be utilized to create the desired male-female connection.

Figure 7:
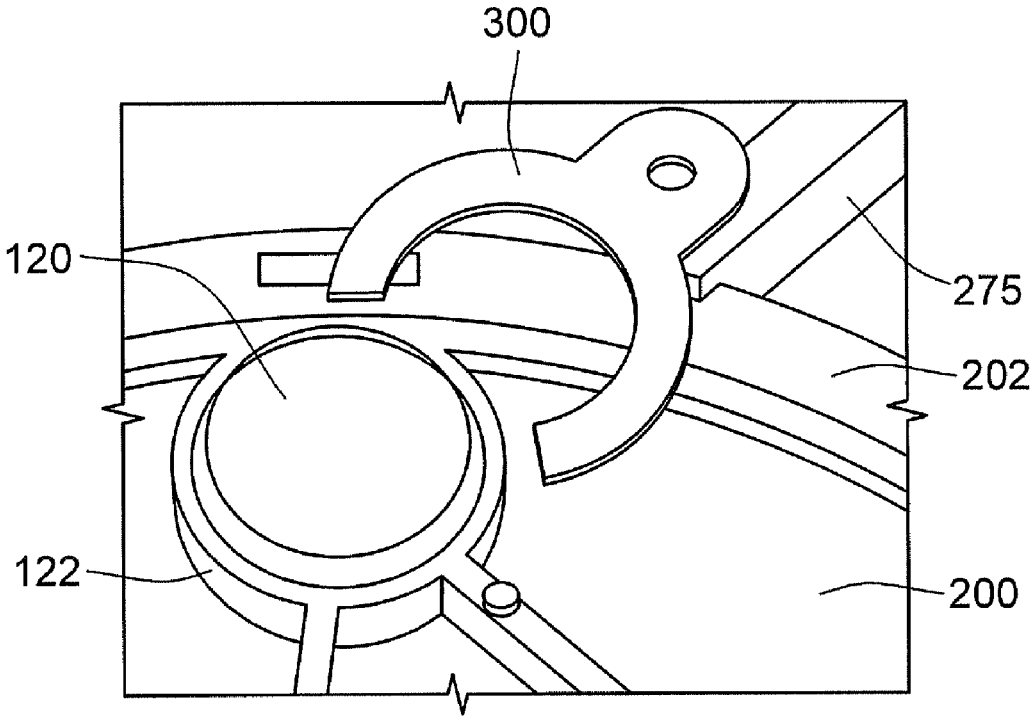
FIG. 7 illustrates a bottom view of a clamp configured to at least partially secure a bladder segment to a base plate.

FIG. 7 illustrates an embodiment of the present invention where the protrusions 120 shown in FIG. 5 are configured to at least partially extend beyond the bottom surface 202 of the base 200 when the protrusions 120 are placed in the orifices 122. In this example, a clamp 300 is configured to at least partially secure a bladder segment 102 to a base 200. For example, as shown in FIG. 7, at least s portion of the end of the protrusion 120 is configured to mate with a clamp 300. More specifically, the clamp 300 is configured to be placed around at least a portion of the outer perimeter of a portion of the protrusion 120 that extends beyond the bottom surface 202. The clamp 300 and/or protrusion may be configured so as to clamp is secured to the protrusion through a compressive force exerted on the protrusion 120. According to another embodiment, the protrusion 120 may include a recessed portion that is smaller than the width or diameter of the end portion of the protrusion 122 extending from the bottom surface 202 so that the clamp 300 may be slid onto or fitted around the recessed portion of the protrusion 120 between the bottom surface 202 and the end of the protrusion 122.

Figure 8:
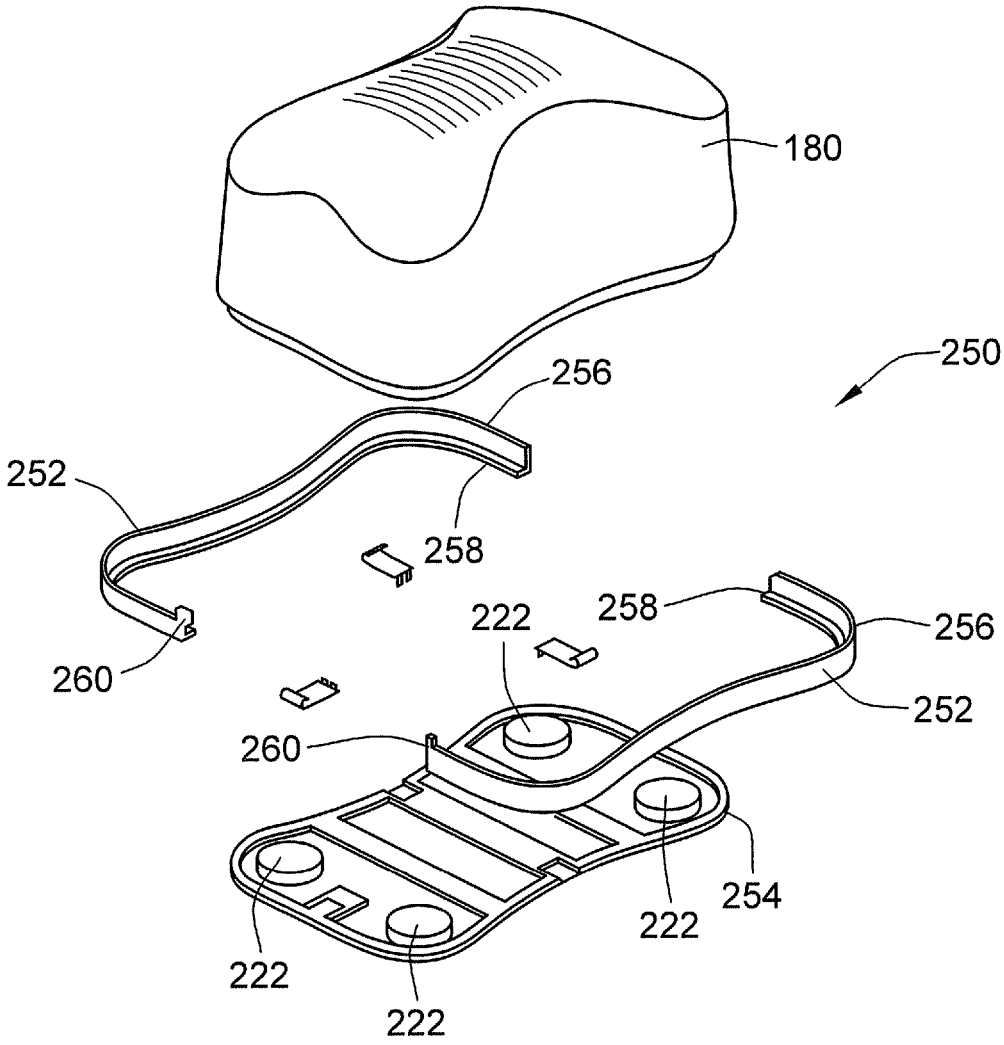
FIG. 8 illustrates an exploded view of a bladder segment and base according to an embodiment of the present invention.
Figure 9:
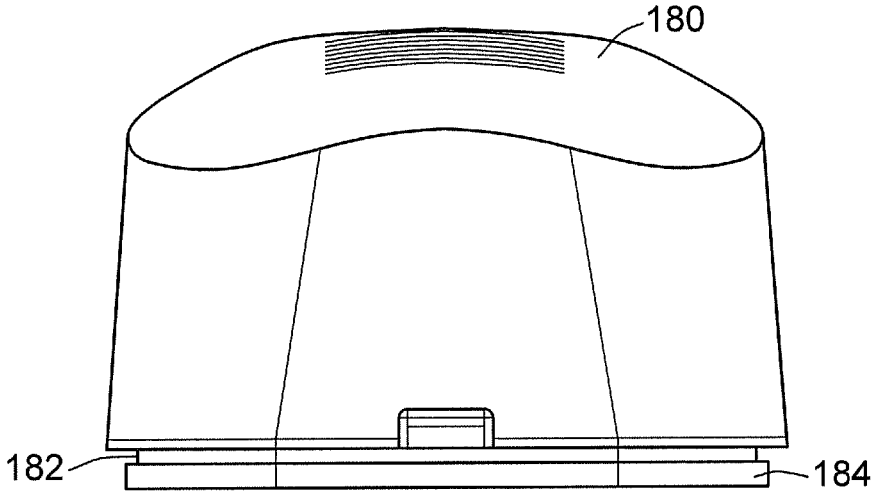
FIG. 9 illustrates a side view of an inflatable exercise apparatus according to an embodiment of the present invention.

FIG. 8 illustrates an exploded view of a bladder segment 180 and base 250 according to an embodiment of the present invention. In this embodiment, the base 250 may include side arms 252 and a base plate 254, the side arms 252 being configured to receive and/or mate with at least a portion of the bladder segment 180 and a base plate 254. For example, in the embodiment illustrated in FIG. 9, the bladder segment 180 may include a recessed area 182 and a protrusion 184. The side arms 252 may include upper lip surfaces 256 and lower lip surfaces 258, wherein at least a portion of the upper lip surface 252 may be placed generally into the recessed area 182 on the bladder segment 180. Further, at least a portion of the lower lip surface 252 may be positioned below the protrusion 184. The side arms 252 may connectors 260 that may allow side arms 252 to be fastened together, such as through the use of mechanical fasteners, including, for example, screws, bolts, pins, and hook and loop material, among others. The side arms 252, including the upper and lower lip surfaces 256, 258, may be positioned about the bladder segment 180 so that, when the side arms 252 are connected, the bladder segment 180 is securely connected to the side arms 252. Additionally, the base plate 254 may be operably secured to the side arms 252, such as, for example, through the use of mechanical fasteners, such as bolts, nuts, and screw. Alternatively, the base plate 250 may be secured by fitting into a recess in the side arms 252 so that when the side arms 252 are connected to each other, the base plate 250 is secured between the side arms 252.

Figure 10:
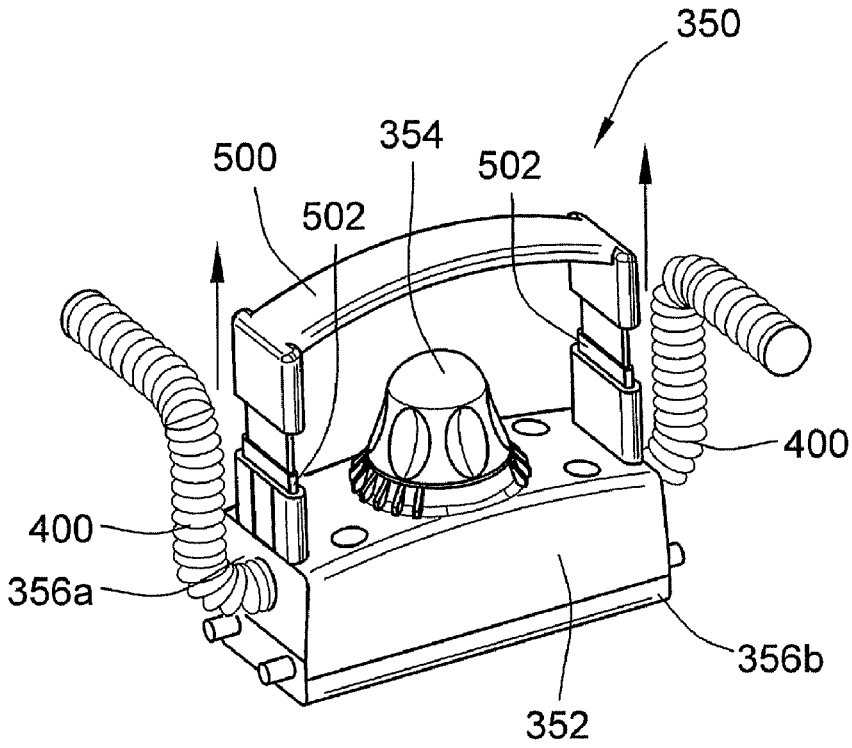
FIG. 10 illustrates a perspective view of a valve control mechanism and fluid passageways according to an embodiment of the present invention.

FIG. 10 illustrates a perspective view of a valve control mechanism 350 and fluid passageways 400 according to an embodiment of the present invention. The fluid passageways 400 may be tubing or conduit that assists in the passage of a fluid between the bladder segments 102*a*, 102*b*. The bladder segments 102*a*, 102*b* may be in fluid communication through the connecting fluid passageway 400. It is contemplated that the connecting fluid passageway 400 may be comprised of the same material as the bladder segments 102*a*, 102*b*, or different material, including, for example, a flexible rubber conduit, among others. According to embodiments of the present invention, the fluid passageway 400 may be a single or multiple pieces of conduit that integrally connect the bladder segments 102*a*, 102*b* together and allows, when unobstructed, for the passage of an inflation fluid between the bladder segments 102*a*, 102*b*.

According to certain embodiments, the valve control mechanism 350 is positioned between the bladder segments 102*a*, 102*b*. The valve control mechanism 350 is configured to control, regulate, and/or prohibit the flow of fluid, such as air, between the bladder segments 102*a*, 102*b*. For example, in the closed position, the valve control mechanism 350 may close the connecting fluid passageway 400, thereby preventing any inflation fluid from being communicated between the bladder segments 102*a*, 102*b*. In the open position, the valve control mechanism 350 allows the inflation fluid to communicate between the bladder segments 102*a*, 102*b*. Therefore, through the opening and closing of the valve control mechanism 350, fluid may be transferred between the bladder segments 102*a*, 102*b*, which may allow for an adjustment in the amount of fluid pressure, such as gas pressure, in the bladder segments 102*a*, 102*b*. By being able to adjust the pressure of the bladder segments 102*a*, 102*b*, the bladder segments 102*a*, 102*b* may be adjusted to have similar or different fluid pressure, and thereby provided different resistance during use. Further, the valve control mechanism 350 may be adjusted to allow a little or a lot of fluid to be released from one bladder segment 102*a*, 102*b* to another bladder segment 102*a*, 102*b* during use, thereby further allowing for variations in resistance caused by fluid pressure during physical rehabilitation or exercise.

Figure 11:
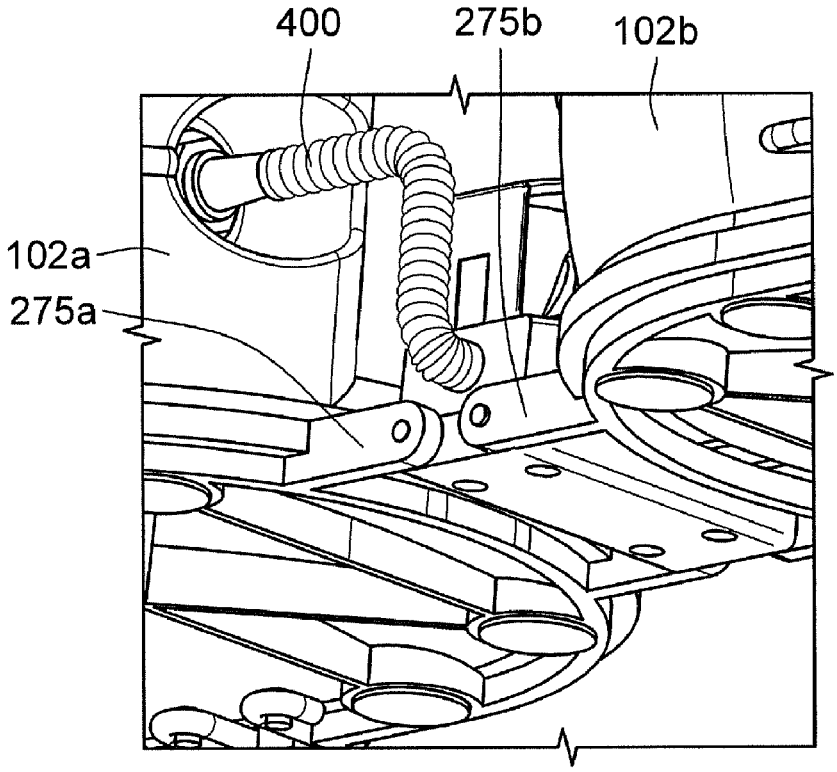
FIG. 11 illustrates a side perspective view of a portion of a fluid passageway connected to a bladder segment.

According to one embodiment of the present invention, the valve control mechanism 350 is a ball valve, such as a clamp ball valve, among others. The valve control mechanism 350 may include a valve housing 352 and a dial or handle 354. Further, as shown in FIG. 2, at least one the bladder segments 102*a*, 102*b* in proximity to the handle 354 may have a recess 333 that may facilitate the ability of the user reach and/or operate the handle 354 without interference from the bladder segment 102*a*, 102*b*. The housing may include sides 356*a*, 356*b* that are configured to be operably connected to a first end of the fluid passageways 400, such as, for example, through the use of a nipple or threaded connection, among others. The second ends of the fluid passageways 400 may be operably connected to the bladder segments 102*a*, 102*b*, as shown in FIG. 11, such as, for example, through a threaded connection, a compressed connection, and adhesive, or the use of a nipple, among others, The valve housing 352 may include a conduit through which the fluid is able to pass through the housing 362. However, within the housing may be a valve, such as a ball valve, that may be operated to allow, block, or partially block the flow of fluid through the housing, and thus between the bladder segments 102*a*, 102*b*. Accordingly, through operation of the handle 354, the user may control whether fluid may flow between the bladder segments 102*a*, 102*b*, or the rate at which the fluid may flow between the bladder segments 102*a*, 102*b*.

Figure 12:
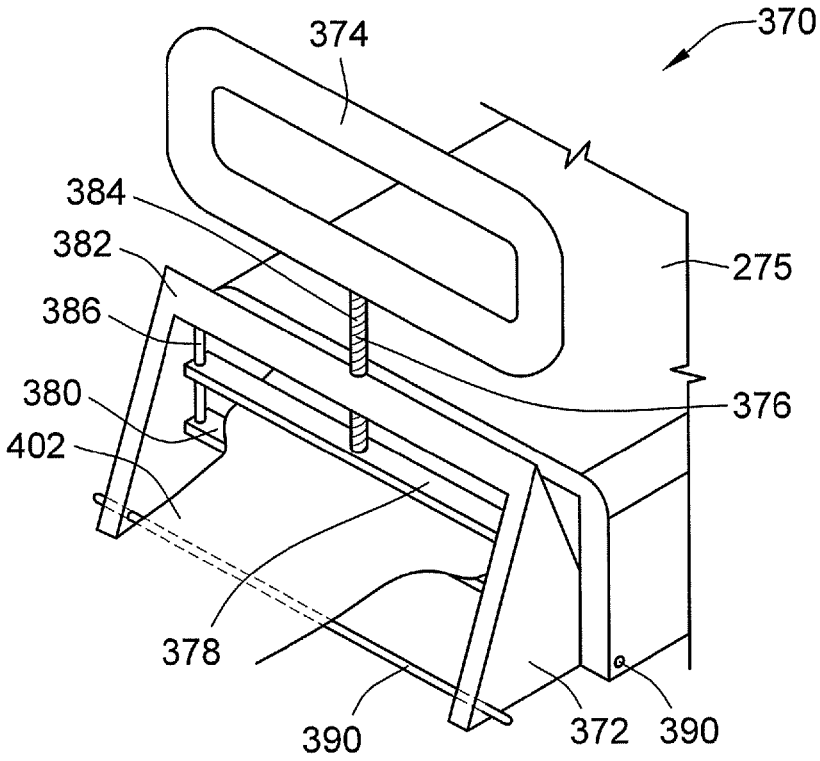
FIG. 12 illustrates a top perspective view of a valve control mechanism according to an embodiment of the present invention.
Figure 13:
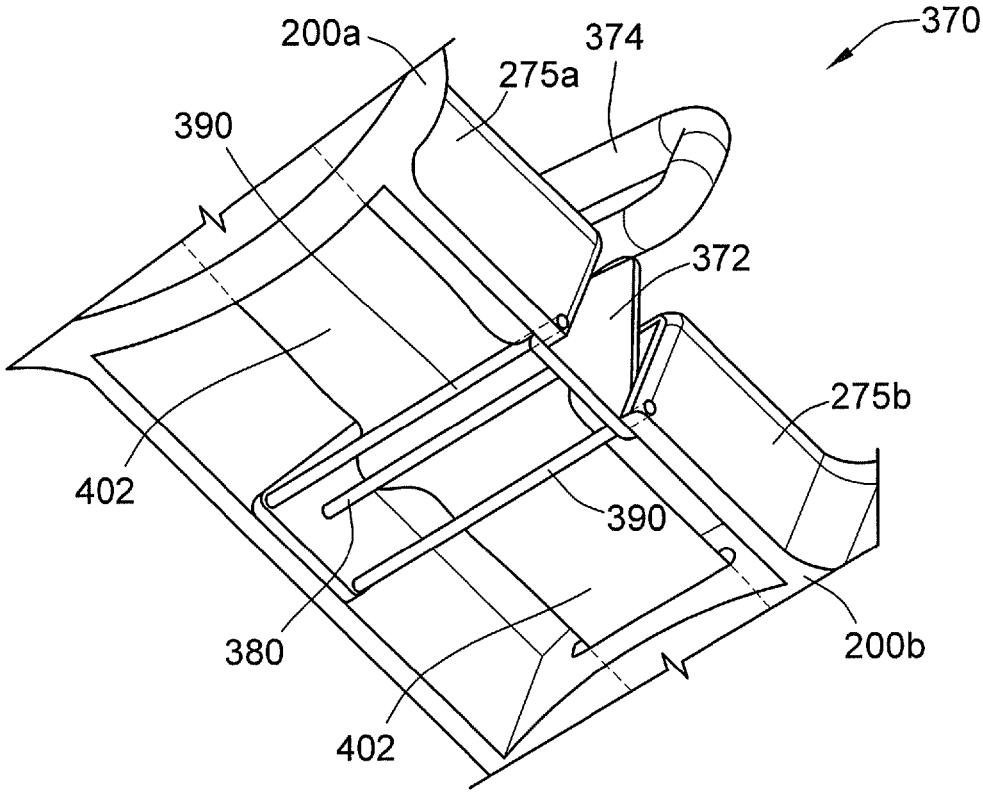
FIG. 13 illustrates a bottom perspective view of a valve control mechanism with a portion of one base removed for illustration purposes according to an embodiment of the present invention.

FIGS. 12 and 13 illustrate top and bottom perspective view, respectively, of a valve control mechanism 370 according to an embodiment of the present invention. The valve control mechanism 370 may include a valve housing 372, handle 374, rod 376, moveable upper clamping bar 378, and a stationary lower clamping bar 380. According to such embodiments, the connecting fluid passageway 402 passes in between the moveable upper clamping bar 378 and the stationary lower clamping bar 380. At least a portion of the rod 376 has an external thread set. The rod 376 passes through a hole ratcheting bore in an upper portion 382 of the valve housing 372. The ratcheting bore may include a reciprocal internal thread set that engages the external thread set of the rod 376. The rod 376 has a first end 384 and a second end. The first end 384 of the rod 376 attaches to the handle 374. The second end of the rod 376 attaches to the moveable upper clamping bar 378. The moveable upper clamping bar 378 may be slidably connected to guide posts 386. The guide posts 386 may be connected to the upper portion 382 of the valve housing 372. A second end of the guide post 386 may be connected to the stationary lower clamping bar 75.

In example of operation, the valve control mechanism 370 can be closed by manually rotating the handle 374. As the handle 374 is rotated, the external thread set on the rod 374 engages the internal thread set of the ratcheting bore and the rod 376 drives the moveable upper clamping bar 378 downward, thereby engaging the moveable upper clamping bar 378 with the connecting fluid passageway 402 and forcing the connecting fluid passageway 402 to compress against the stationary lower clamping bar 380. The guide post 386 guides the moveable upper clamping bar 378 during its downward movement. The handle 374 can be rotated in a until moveable upper clamping bar 378 and the stationary lower clamping bar 380 are securely tightened around the connecting fluid passageway 402, thereby blocking the flow of fluid between the bladder segments 102*a*, 102*b*.

To open valve control mechanism 370, the handle 374 is rotated in the opposite direction that is rotated when the valve control mechanism was tightened about the fluid passageway 402. This opposite rotation of the handle 374 causes the moveable upper clamping bar 378 to travel up the guide post 386 and recede from the stationary lower clamping bar 380. This action opens the valve control mechanism 370 and permits the inflation gas to communicate between the bladder segments 102*a*, 102*b*. According to another embodiment, the upper clamping bar 378 may be stationary, and the lower clamping bar may be moved along guide posts 286 through rotation of the handle 374.

Figure 14:
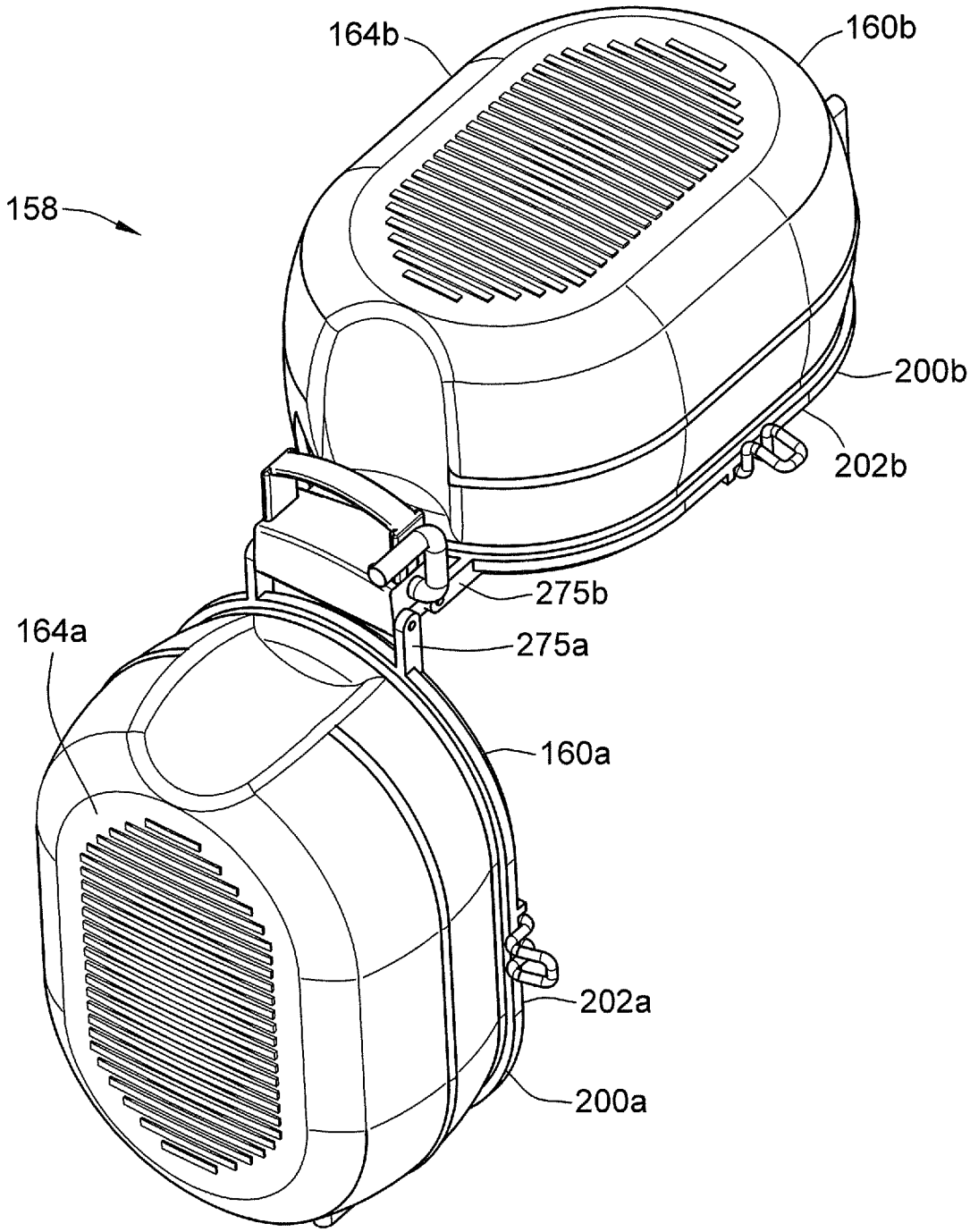
FIG. 14 illustrates a side perspective view of an inflatable exercise apparatus partially folded according to an embodiment of the present invention.

FIG. 14 illustrates a side perspective view of an inflatable exercise apparatus 158 partially folded according to an embodiment of the present invention. According to embodiments of the present invention, the apparatus 158 may be folded so that the bottom surfaces 202*a*, 202*b* of bases 200*a*, 200*b* are adjacent to each other. According to other embodiments of the present invention, the apparatus 100 may be and/or the upper surfaces 164*a*, 164*b* of the bladder segments 160*a*, 160*b* are in close proximity. Folding of the apparatus of the present invention may occur through the use of pivotable or hinged connections. For example, the base 200*a* for a first bladder segment 102*a* may include or be operably connected to, such as through the use of mechanical fasteners, at least one arm that pivotably mates with at least one arms from, or operably connected to, the base 200*b* of the second bladder segment 102*b*. Alternatively, the bases 200*a*, 200*b* may include at least one arm 275*a*, 275*b*, as shown in FIGS. 1, 2, 3, 5, 11, 12 and 14, that are pivotably connected to the housing of the valve control mechanism. For example, as shown in FIGS. 12 and 13, the housing 372 of the valve control mechanism 370 may be pivotably attached to the bases 200*a*, 200*b* through pivot rods 390. The bases 200*a*, 200*b* may by pivotably rotated about the pivot rods 390 allowing the bladder segments 102*a*, 102*b*, 164*a*, 164*b* attached to the bases 200*a*, 200*b* to be folded together into a folded, or storage position.

According to embodiments of the present invention, the apparatus of the present invention may include a transport handle used to move or carry the apparatus, particularly then the apparatus is in a folded or storage position. For example, according to embodiments of the present invention, the transport handle may be the handle 374 used to operate the valve control mechanism. According to other embodiments, a separate transport handle 500 may be operably connected to the housing 352 of the valve control mechanism 350, such as through tracks 502 that are part of or connected to the housing 352 or through the use of mechanical fasteners, among others. Further, the transport handle 500 may be retractable or expandable, as illustrated by the arrows in FIG. 10 so that the transport handle 500 may be extended away from the housing when the transport handle is being used, a pushed down toward or into the housing, or recessed, when not in use. Alternatively, the transport handle 500 may be pivotable so as to be pivoted downward when not being used. Additionally, the transport handle 500 may be operably connected to the housing through the use of straps or fabric that allow the transport handle 500 to be pulled away from the housing 352 when in use and lay on or near the housing when the transport handle 500 is not being used.

Figure 15:
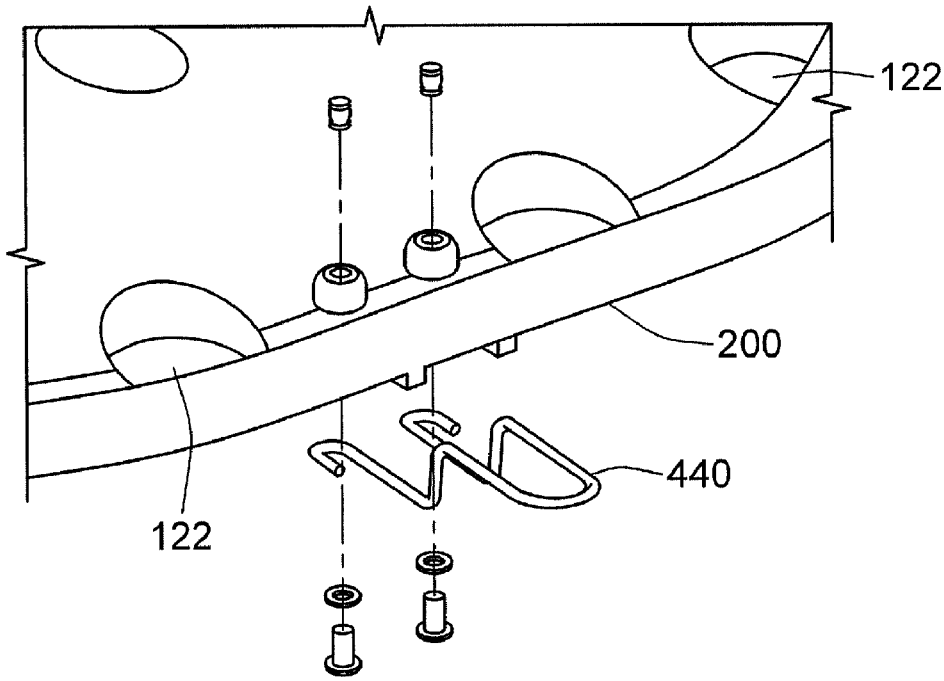
FIG. 15 illustrates an exploded view of a base plate being operably connected to a band bracket according to an embodiment of the present invention.

FIG. 15 illustrates an exploded view of a base plate 200 being operably connected to a band bracket 440 according to an embodiment of the present invention. According to certain embodiments, at least one base 200 may include at least one band bracket 440. According to embodiments of the present invention, the band bracket 440 may be a metallic, plastic, or composite material that is secured to the base 200 through mechanical fasteners, such as pins, screws, bolts, and/or nuts, among others. According to other embodiments of the present invention, the band bracket 440 may be part of the base 200, such as being molded into the base 200. Band brackets 440 may be places along one or more sides of the base 200.

Figure 16:
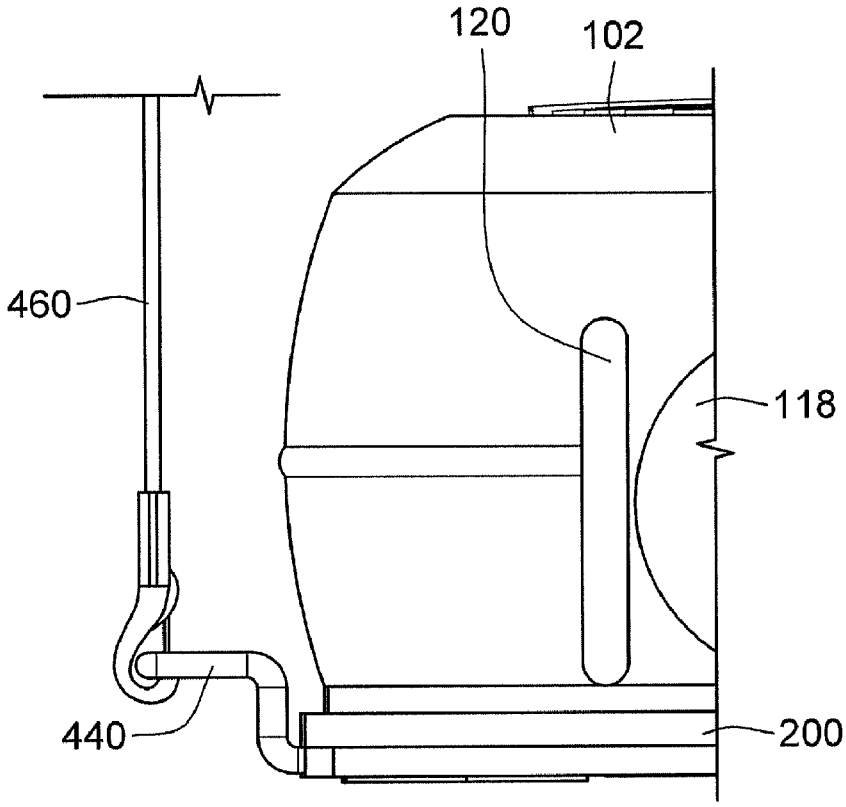
FIG. 16 illustrates a side view of a portion of the inflatable exercise apparatus having a power/resistance band operably connected to a band bracket according to an embodiment of the present invention.

FIG. 16 illustrates a side view of a portion of the inflatable exercise apparatus having a power/resistance band 460 operably connected to a band bracket 440 according to an embodiment of the present invention. The band bracket 440 may allow for the attachment of external exercise devices to the base 200, such as, for example, therapeutic/exercise band, external balancing tools, or the like. The band bracket 440 may take a variety of forms, including, for example, having an a opening that is sized to receive the placement of at least a portion of an ancillary exercise device, or may be rod around which at least a portion of the ancillary exercise device may be placed or wrapped. As shown in FIG. 16, according to an embodiment of the present invention, the band bracket 440 may be configured to attach to an external exercise device through the use of a clasp.

While the apparatus has been described with reference to preferred embodiments, it will be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed, but that the invention will include all embodiments falling within the scope of the appended claims.

The invention claimed is:

1. An inflatable exercise apparatus comprising:

at least two inflatable bladder segments in fluid communication, the at least two inflatable bladder segments having an upper surface, a side surface, and a bottom surface, the upper surface having a generally flat plateau;

a base operably connected to the at least two inflatable bladder segments;

a control valve mechanism, the control valve mechanism configured to control the fluid communication between the at least two inflatable bladder segments; and at least one band bracket operably connected to the base.

2. The inflatable exercise apparatus of claim 1 further including a plurality of ridges along at least a portion of the upper surface of the at least two bladder segments.

3. The inflatable exercise apparatus of claim 2 wherein the plurality of ridges have a generally curved profile.

4. The inflatable exercise apparatus of claim 1 further including fluid passageways, the fluid passageways configured to assist in the passage of a fluid between the at least two bladder segments.

5. The inflatable exercise apparatus of claim 1 wherein the inflatable exercise apparatus has a generally oblong elliptical shape.

6. The inflatable exercise apparatus of claim 1 wherein the control valve mechanism includes a ball valve.

7. The inflatable exercise apparatus of claim 1 wherein the control valve mechanism includes a clamp bar.

8. The inflatable exercise apparatus of claim 1 wherein the base includes an individual base for each of the at least two inflatable bladder segments.

9. The inflatable exercise apparatus of claim 1 wherein the at least two inflatable bladder segments have generally oblong elliptical shapes.

10. An inflatable exercise apparatus comprising:

at least two inflatable bladder segments in fluid communication, the at least two inflatable bladder segments having an upper surface, a side surface, and a bottom surface, the upper surface having a generally flat plateau;

a base operably connected to the at least two inflatable bladder segments, wherein the base includes an individual base operably connected to each of the at least two inflatable bladder segments;

a control valve mechanism, the control valve mechanism configured to control the fluid communication between the at least two inflatable bladder segments wherein the control valve mechanism includes a housing, and wherein each individual base is pivotably attached to the housing.

11. An inflatable exercise apparatus comprising:

a first inflatable bladder segment, the first inflatable bladder segment having an upper surface, the upper surface having a generally flat plateau;

a first base operably connected to the first inflatable bladder segment;

a second inflatable bladder segment in fluid communication with the first inflatable bladder segment, the second inflatable bladder segment having an upper surface, the upper surface having a generally flat plateau;

a second base operably connected to the second inflatable bladder segment; and a control valve mechanism, the control valve mechanism having a housing, the first base pivotably connected to the housing, the control valve mechanism configured to control the flow of fluid communication between the inflatable bladder segments.

12. The inflatable exercise apparatus of claim 11 further including a plurality of ridges along at least a portion of the upper surface of the first and second bladder segments.

13. The inflatable exercise apparatus of claim 12 wherein the inflatable exercise apparatus has a generally oblong elliptical shape.

14. The inflatable exercise apparatus of claim 12 wherein the plurality of ridges have a generally curved profile.

15. The inflatable exercise apparatus of claim 11 further including at least one band bracket operably connected to the base.

16. The inflatable exercise apparatus of claim 11 wherein the control valve mechanism includes a ball valve.

17. The inflatable exercise apparatus of claim 11 wherein the first inflatable bladder segment has a generally oblong elliptical shape and the second inflatable bladder segment has a generally oblong elliptical shape.

18. An inflatable exercise apparatus comprising:

a first inflatable bladder segment, the first inflatable bladder segment having an upper surface, the upper surface having a generally flat plateau;

a first base operably connected to the first inflatable bladder segment;

a second inflatable bladder segment in fluid communication with the first inflatable bladder segment, the second inflatable bladder segment having an upper surface, the upper surface having a generally flat plateau;

a second base operably connected to the second inflatable bladder segment;

a plurality of ridges above at least a portion of the upper surface of the first and second inflatable bladder segments wherein the plurality of ridges have a generally curved profile;

a fluid passageway operably connecting the first and second inflatable bladders to allow for fluid communication between the first and second inflatable bladder segments; and a control valve mechanism configured to control the flow of fluid along the fluid passageway.

19. The inflatable exercise apparatus of claim 18 wherein the first inflatable bladder segment has a generally oblong elliptical shape and the second inflatable bladder segment has a generally oblong elliptical shape.

20. An inflatable exercise apparatus comprising:

a first inflatable bladder segment, the first inflatable bladder segment having an upper surface, the upper surface having a generally flat plateau;

a first base operably connected to the first inflatable bladder segment;

a second inflatable bladder segment in fluid communication with the first inflatable bladder segment, the second inflatable bladder segment having an upper surface, the upper surface having a generally flat plateau;

a second base operably connected to the second inflatable bladder segment;

a plurality of ridges above at least a portion of the upper surface of the first and second inflatable bladder segments;

a fluid passageway operably connecting the first and second inflatable bladders to allow for fluid communication between the first and second inflatable bladder segments; and a control valve mechanism configured to control the flow of fluid along the fluid passageway;

wherein the inflatable exercise apparatus has a generally oblong elliptical shape.

21. An inflatable exercise apparatus comprising:

a first inflatable bladder segment, the first inflatable bladder segment having an upper surface, the upper surface having a generally flat plateau;

a first base operably connected to the first inflatable bladder segment, at least one band bracket operably connected to the first base;

a second inflatable bladder segment in fluid communication with the first inflatable bladder segment, the second inflatable bladder segment having an upper surface, the upper surface having a generally flat plateau;

a second base operably connected to the second inflatable bladder segment, at least one band bracket operably connected to the second base;

a plurality of ridges above at least a portion of the upper surface of the first and second inflatable bladder segments;

a fluid passageway operably connecting the first and second inflatable bladders to allow for fluid communication between the first and second inflatable bladder segments; and a control valve mechanism configured to control the flow of fluid along the fluid passageway.

22. The inflatable exercise apparatus of claim 21 wherein the first inflatable bladder segment has a generally oblong elliptical shape and the second inflatable bladder segment has a generally oblong elliptical shape.

* * * * *